US010881183B2

(12) United States Patent
Balestrini et al.

(10) Patent No.: US 10,881,183 B2
(45) Date of Patent: Jan. 5, 2021

(54) COSMETIC PRODUCT APPLICATOR TIP, ASSOCIATED APPLICATOR AND APPLICATOR ASSEMBLY

(71) Applicant: ALBEA SERVICES, Gennevilliers (FR)

(72) Inventors: Thierry Balestrini, Leudeville (FR); Yann Crapet, Fremecourt (FR)

(73) Assignee: ALBEA SERVICES, Gennevilliers (FR)

( * ) Notice: Subject to any disclaimer, the term of this patent is extended or adjusted under 35 U.S.C. 154(b) by 0 days.

(21) Appl. No.: 16/026,013

(22) Filed: Jul. 2, 2018

(65) Prior Publication Data

US 2019/0000212 A1 Jan. 3, 2019

(30) Foreign Application Priority Data

Jun. 30, 2017 (FR) ..... 17 56223

(51) Int. Cl.
*A45D 34/04* (2006.01)
*A45D 40/26* (2006.01)

(52) U.S. Cl.
CPC ..... *A45D 34/043* (2013.01); *A45D 34/045* (2013.01); *A45D 34/046* (2013.01); *A45D 40/265* (2013.01); *A45D 2200/1018* (2013.01)

(58) Field of Classification Search
CPC .. A45D 34/043; A45D 34/045; A45D 34/046; A45D 40/265; A45D 2200/1018
See application file for complete search history.

(56) References Cited

U.S. PATENT DOCUMENTS 3,428,404 A * 2/1969 Ciancio ..... A45D 34/043 401/109
2002/0048482 A1* 4/2002 Gueret ..... A45D 34/045 401/130
2003/0089379 A1* 5/2003 Gueret ..... A45D 34/046 132/218
2004/0161285 A1* 8/2004 Gueret ..... A45D 34/04 401/130
2006/0013639 A1* 1/2006 Gueret ..... A45D 34/045 401/130
2006/0272670 A1* 12/2006 Gueret ..... A45D 34/042 132/317
2012/0082503 A1* 4/2012 Gueret ..... A45D 40/267 401/122
2019/0000222 A1* 1/2019 Balestrini ..... A46B 9/021

FOREIGN PATENT DOCUMENTS

EP 1440629 7/2004

* cited by examiner

*Primary Examiner* — J C Jacyna
(74) *Attorney, Agent, or Firm* — Steven M. Greenberg, Esq.; Shutts & Bowen LLP

(57) ABSTRACT

A cosmetic product applicator tip includes an attachment part suitable for being assembled with a support rod and an application part of the product extending along a main direction. The attachment part includes a support finger external to the support rod, the application part being attached to the support finger so as to encompass most of the support finger. The application part is configured to switch from an idle position wherein the support finger and the proximal end of the application part are free from any contact to a use position, wherein the support finger and/or the application part yield such that the proximal end of the application part is at the point of coming, or comes, into contact with the support finger and/or the support rod.

11 Claims, 2 Drawing Sheets

COSMETIC PRODUCT APPLICATOR TIP, ASSOCIATED APPLICATOR AND APPLICATOR ASSEMBLY

This application claims priority under 35 U.S.C. § 119(a) to French Patent Application No. 1756223, filed Jun. 30, 2017.

BACKGROUND OF THE INVENTION

Field of the Invention

The invention relates to a cosmetic product applicator tip, associated applicator and applicator assembly.

Description of the Related Art

Cosmetic product applicator assemblies are known, particularly for cosmetic products intended to be applied on a user's lips. The applicator assemblies include a receptacle containing the cosmetic product and an applicator suitable for being removably attached to the receptacle.

The receptacle generally includes a body, the body includes walls delimiting a container wherein the cosmetic product is contained, and a neck defining an opening whereby the cosmetic product may be removed. The applicator generally includes a cap suitable for being attached to the neck, a rod extending from the cap and an applicator tip attached to a free end of the rod.

When the cap is attached to the neck, the rod and applicator tip extend inside the container. The applicator is immersed in the cosmetic product contained in the container.

To use the applicator, the user detaches the cap from the neck and removes the applicator from the receptacle.

Known applicator tips generally have a spatula-shaped area intended to come into contact with the lips whereon makeup is to be applied, particularly to lay cosmetic product thereon. However, the spatula-shaped area usually only allows local application of cosmetic product, in particularly on one lip at a time. The spatula also exhibits uncomfortable rigidity when pressure is applied on the lips.

Tips also exist wherein the application surface is presented as a sphere attached to an end of the rod. These tips enable the application of the cosmetic product on both of the user's lips, but they are difficult to squeeze, and a large quantity of product is accumulated between the tip and the rod, rendering application difficult.

BRIEF SUMMARY OF THE INVENTION

The present invention aims to propose an applicator tip suitable for applying makeup, in a single application, to both of a user's lips while retaining comfort of use during makeup application and easy squeezing. As such, the invention relates to a cosmetic product applicator tip, the applicator tip including an attachment part suitable for being assembled with a support rod and a part for applying the product. The application part extends along a main longitudinal extension direction, or main direction, between a proximal end and a distal end opposite the proximal end. The attachment part includes a support finger external to the support rod. The application part is attached to the support finger so as to encompass most of the support finger, the support finger and the application finger being in discrete contact over a limited area in the vicinity of the distal end of the application part. The application part is configured to switch from an idle position wherein the support finger and the proximal end of the application part are free from any contact to a use position, wherein the support finger (15) and/or the application part (20) yield such that the proximal end of the application part is at the point of coming, or comes, into contact with the support finger and/or the support rod.

In other words, the applicator tip includes an application part attached to a support finger so as to encompass most thereof, such as a cap covering the support finger extending from the distal end of the application part to the support rod. The applicator has a very distinctive "mushroom", or "umbrella", shape. The gap between the application part and the support rod is thereby reduced and an accumulation of product at this point after squeezing which is liable to run and discomfort for applying the product are avoided. Moreover, the gap between the application part, and the support rod gives the applicator tip flexibility; this flexibility provides the tip with comfort of use, particularly for applying makeup on a user's lips. This gap is definable as a hollow, particularly in the form of a volume of revolution, about a support finger, delimited by the internal walls and the support finger and forming a container.

According to various embodiments of the invention, which may be taken together or separately:

- the application part has an internal wall and an external wall that are opposite,
- the internal wall and the external wall are separated by a material thickness,
- the external wall is merged with an application surface,
- the application surface is continuous,
- a gap between the internal wall of the application part and the support finger is formed so as delimit a cavity,
- the support finger and the application part are at the point of coming or come into contact via the internal wall of the application part,
- the attachment part and the application part are two separate pieces,
- the attachment part and the application part are a single piece,
- the support finger is rigid,
- the support finger is flexible,
- the cavity is devised so as to serve as an intermediate container for the cosmetic product to be applied,
- the attachment part and the application part are made of different materials,
- the attachment part and the application part are made of an identical material,
- the material thickness between the internal wall and the external wall of the application part is variable,
- the material thickness between the internal wall and the external wall of the application part is constant,
- the application part includes at least one opening.
- the application part has an oval shape,
- the attachment part and the application part are moulded pieces,
- the attachment part and/or the application part includes an elastomer material,
- particularly thermoplastic elastomers (TPE), butadiene-acrylonitrile copolymers (NBR), silicones,
- the attachment part may further include a thermoplastic material such as polypropylene (PP), polyethylene terephthalate (PET) or poly-oxo-methylene (POM),
- the external wall of the application part is smooth and/or flocked,
- the flocking of the application part includes cotton or nylon.

The invention also relates to an applicator including an applicator tip as described above and the support rod. Advantageously:

- the rod, of substantially cylindrical shape, has a diameter D,
- the application part has a circular cross-section of maximum diameter d,
- the two diameters D, d are correlated with the following formula: $0.9 \leq d/D \leq 1.5$,
- the rod includes a main longitudinal extension direction merged with the main direction of the applicator.

The invention also relates to a cosmetic product applicator assembly, including a receptacle including a body forming a container intended to contain the cosmetic product, and an applicator as described above, suitable for being attached to the receptacle, such that the applicator tip is housed inside the container.

According to various embodiments of the invention, which may be taken together or separately:

- the receptacle further includes a neck defining an opening whereby the cosmetic product may be removed, and a squeezing device, attached to the inside of the neck,
- the applicator assembly further includes a cap suitable for being attached to the neck, the rod extending from the cap,
- the squeezing device further includes a squeezing orifice configured to remove the excess cosmetic product on the applicator,
- the diameter of the squeezing orifice is substantially the same as that of the applicator rod.

The invention further relates to the applicator assembly wherein the container is filled with cosmetic product, the product being particularly intended for applying makeup on a user's lips.

The invention will be understood more clearly, and further aims, details, features and advantages thereof will emerge more clearly in the course of the detailed explanatory description hereinafter, of at least one embodiment of the invention given by way of merely illustrative and non-limiting example, with reference to the appended schematic figures.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Figure 1:
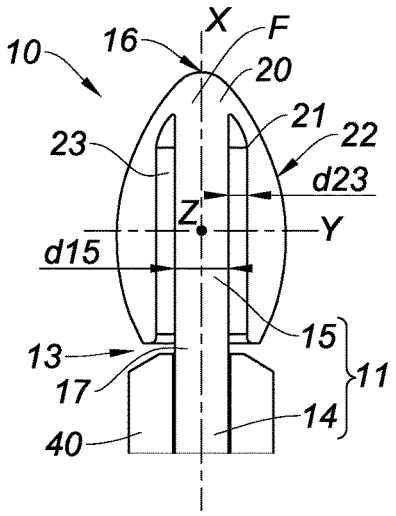
FIG. 1 is a sectional view of a first example of an embodiment of an applicator tip according to the invention in the idle position.

FIG. 1 illustrates a first example of a cosmetic product applicator tip 10 according to the invention. The applicator tip 10 extends along a main longitudinal extension direction, referred to as the main direction and marked X in the figures. The applicator tip 10 includes an application part 20. The term "application part" denotes a part of the applicator tip that is suitable for holding cosmetic product when it is placed in contact therewith, and for subsequently supplying same.

The application part 20 extends along the main direction, between a proximal end 13 and a distal end 16, opposite the proximal end. The application part 20 has an internal wall 21 and an external wall, the external wall being merged with an application surface 22. The term "application surface" denotes a surface devoid of protuberances such as the protuberances of mascara brushes used for applying the product. It consists of the external surface of the application part 20.

Preferably, the application surface 22 is rounded and extends from the distal end 16 to the proximal end 13 of the application part 20. The application part 20 has an elongated longitudinal section to the main direction X, particularly in the shape of an oval wherein a portion of material is missing at the proximal end 13, and a circular transverse section to the main direction X and having a maximum diameter d. This elongated shape provides a greater application surface 22 while retaining a restricted diameter of the application part 20 to facilitate the introduction thereof into a receptacle 50 containing the cosmetic product.

Moreover, the applicator tip 10 includes an attachment part 11 presented herein in the form of a sleeve 14 and a support finger 15. The sleeve 14 is configured to be assembled with a support rod 40, herein integrated in the support rod 40. The support finger 15 extends from the sleeve (14) and the support rod 40 and is configured to link the application part 20 with the sleeve 14. In other words, the sleeve 14 and the support rod 40 are separate pieces intended to be in integrated linkage once assembled together.

The application part 20 is thereby attached to the support finger 15 so as to encompass most thereof. In other words, the application part 20 is a casing such as a cap surrounding the support finger 15 and extending from the distal end 16 to the sleeve 14.

In other words, the applicator has a very distinctive "mushroom", or "umbrella", shape.

In this way, once the tip 10 has been attached to the support rod 40, the casing extends to the support rod 40 reducing the gap between the application part 20 and the support rod 40. As such, an accumulation of product at this point after squeezing which is liable to run and discomfort for applying the product are avoided.

For this attachment, the support finger 15 and the application part 20 are in discrete contact over a limited area in the vicinity of the distal end 16 of the application part 20. The term "discrete contact" denotes contact at an isolated, local point, i.e. contact at an area having a small surface area. In other words, the contact between the support finger 15 and the application part 20 is made via the internal wall 21 of the application part 20. The end of the support finger 15 opposite the sleeve 14 is connected to the internal wall 21 of the distal end 16 of the application part 20 at a point, referred to as the attachment point F. The term "point F" denotes a substantially local contact area providing the casing with a point about which it is suitable to turn. This attachment point F corresponds substantially to the cross-section of the support finger 15, herein a circle of diameter d15 corresponding to that of the support finger 15 which is cylindrical.

Advantageously, the application surface 22 is continuous so as to form a gas between the internal wall 21 of the application part 20 and the support finger 15 thereby delimiting a cavity 23. In other words, the material thickness between the application surface 22 (or external wall) and the internal wall 21 serves as a wall for the cavity 23. The cavity 23 offers the advantage of serving as an intermediate container for the cosmetic product to be applied.

The cavity is devised as an intermediate container.

Indeed, the cavity 23 makes it possible to have sufficient cosmetic product on the applicator tip 10 which ensures that the user is able to apply makeup, in a single application without having to refill the applicator tip 10 with cosmetic product. This cavity 23, or gap, helps enable the potential turning of the application part 20 with respect to the support finger 15.

Advantageously, the application part 20 is configured to switch from an idle position wherein the support finger 15 and the proximal end 13 of the application part 20 are free from any contact to a use position, wherein the support finger 15 and/or the application part 20 yield such that the proximal end 13 of the application part 20 are at the point of coming or comes into contact with the support finger 15 and/or the support rod 40. The term "yield" denotes bend, curve, buckle under pressure applied by a user and/or by a squeezing device. The term "at the point of" denotes approaching, touching, bordering on. In other words, under pressure applied, for example by the user, the support finger 15 and/or the application part 20 buckle such that the proximal end 13 of the application part 20 approaches the support finger 15 and/or the support rod 40. The approach may be carried out until the proximal end 13 of the application part 20 is in contact with the support finger 15 and/or the support rod 40 or may stop before the proximal end 13 of the application part 20 comes into contact with the support finger 15 and/or the support rod 40.

Figure 2:
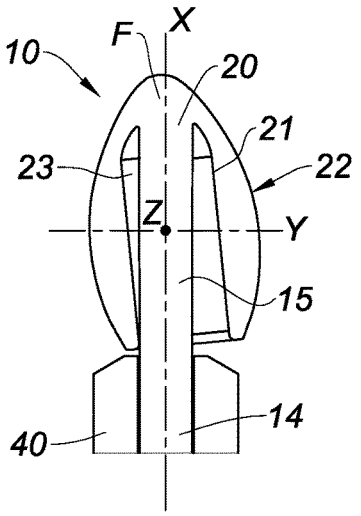
FIG. 2 is a sectional view of the applicator tip in FIG. 1 in a first use position.
Figure 3:
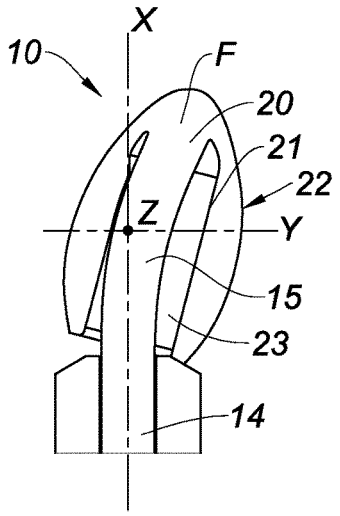
FIG. 3 is a sectional view of the applicator tip in FIG. 1 in a second use position.
Figure 4:
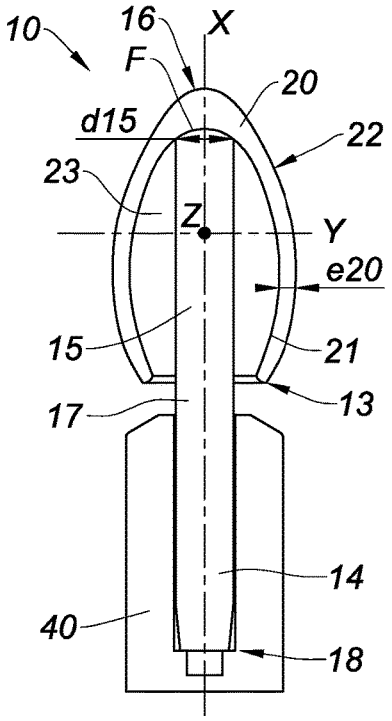
FIG. 4 is a sectional view of a second example of an embodiment of an applicator tip according to the invention in the idle position.

The idle position can be seen in FIGS. 1 and 4. A number of examples of use positions can be seen in FIGS. 2, 3, 5 and 6.

Advantageously to enable the switch of the application part from the idle position to the use position, the application part 20 is flexible. The term "flexible" denotes flexible, deformable particularly upon pressure applied by a user, particularly upon touching a user's lips. This flexibility is particularly provided in that the application part 20 is hollow. Indeed, the material thickness between the application surface 22 and the internal wall 21 is chosen such that the application part 20 is sufficiently flexible to be able to be compressed, particularly during application on the lips. The material thickness may be variable. In other words, the material thickness may vary along the X axis in the direction of a component of the Y and Z axes, as seen hereinafter in the various examples of embodiments.

The material of the application part 20 is also chosen according to the flexibility sought. It particularly consists of materials known for the flexibility and elasticity thereof, such as thermoplastic elastomers (TPE), butadiene-acrylonitrile copolymers, also known as "nitrile rubbers" (NBR), silicones, and more preferentially thermoplastic elastomers (TPE).

This flexibility enables superior precision and comfort of application. It also makes it possible to supply the product contained in the cavity 23 by applying pressure on the application surface 22.

Furthermore, to facilitate the switch to the use position, the support finger 15 may not be completely encompassed by the application part 20. As such, as illustrated in FIGS. 1 to 6, a part of the support finger 15, or intermediate part 17, may not be encompassed by the application part 20. This intermediate part 17 is likewise not integrated in the support rod 40. When the user applies the cosmetic product on lips, pressure is applied on the application part 20. This pressure gives rise to varying compression of the wall of the application part 20 causing the approach of the proximal end 13 of the application part 20 towards the support rod 40 until the proximal end 13 of the casing is at the point of coming or comes into contact with the support finger 15 and/or the support rod 40. The tip is then in a use position. This compression is also favoured by the use of materials exhibiting a certain elasticity. This is particularly visible in FIGS. 5 and 6.

As can be seen in FIGS. 2, 3, 5 and 6, there are a plurality of use positions which may vary from one example of an embodiment to another. Various use positions will be described hereinafter.

The applicator tip 10 may be advantageously obtained by injection, bi-injection, assembly or over-moulding.

Furthermore, in order to avoid any weak area between the sleeve 14 and the application part 20, in particular at the intermediate part 17, the support finger 15 and the sleeve 14 have a section, particularly transverse to the main direction X, of substantially cylindrical shape wherein the diameter d15 is between 1.5 and 3 mm according to the flexibility and material sought, preferably the diameter is at least equal to 1.5 mm, and even more preferably equal to 2 mm.

It may also be envisaged that the application part 20 includes at least one opening (not shown). This may consist for example of holes, perforations or openings made for example in the wall of the application part 20. These openings may serve to supply the product contained in the cavity 23 during application or to enhance the squeezing of the application part 20, the excess product optionally coming out of these openings during squeezing for example.

As can be seen with the two examples of embodiments described hereinafter, the application part 20 and the attachment part 11 may be a single piece (FIGS. 1 to 3) or two separate pieces (FIGS. 4 to 6) and the support finger 15 may be envisaged flexible or rigid.

In the case of a flexible support finger 15, this advantageously includes an elastomer material, in particular an elastomer wherein the hardness is greater than or equal to, approximately, 40 Shore A. Indeed, a hardness less than 40 Shore A would result in an application part 20, made of the same material as the attachment part 11, which would be difficult to inject and too flexible. The term "too flexible"

denotes herein, that at the time of use of the tip 10, and more specifically at the time of the removal of the tip 10 and the squeezing thereof, there would be a risk of the application part 20 turning and of the tip 10 becoming unusable.

As such, in order to prevent any problem at the time of injection and/or use of the tip, the elastomer material will advantageously have a hardness between, approximately, 40 Shore A and, approximately, 90 Shore A, inclusive of the bounds of this range.

A first example of an embodiment will now be described with reference to FIGS. 1 to 3. In this example, the attachment part 11 and the application part 20 are a single piece. Preferably, the attachment part 11 and the application part 20 are made of the same material. In particular, an elastomer material such as thermoplastic elastomers (TPE), butadiene-acrylonitrile copolymers, as known as "nitrile rubbers" (NBR), silicones, preferably a thermoplastic elastomer (TPE).

The cavity 23 is presented in the form of a hollow cylinder, the hollow corresponding to the support finger 15 which is solid. In other words, the internal wall 21 of the application part 20 is coaxial with the X axis and with the support finger 15 in the idle position.

In other words, the cavity is a hollow, in the form of a volume of revolution, about a support finger, delimited by the internal walls and the support finger and forming a container.

In particular, the application part goes around the support finger, particularly on the entire periphery of the finger.

As such, the cavity 23 has a constant distance d23, of the order for example of 0.7 to 1.5 mm. On the other hand, the material thickness between the internal wall 21 and the external wall 22 of the application part 20 is variable along the X axis in the direction of a component of the Y and Z axes. Indeed, the external wall 22 having an oval shape when the user views the tip from the side and the internal wall 21 being coaxial with the X axis, the material thickness is variable along the X axis in the direction of a component of the Y and Z axes and as such has a maximum thickness d of the application part 20, of the order for example of 1.7 mm. This extra thickness makes it possible to obtain the rounded part of the application surface 22 more resistant to the pressure applied by the user at the time of application onto the lips and superior control of the application of the cosmetic product.

In this embodiment, the variable material thickness between the internal wall 21 and the external wall 22 gives a certain rigidity to the application part. Consequently, advantageously, the support finger 15 is flexible.

As shown in FIG. 3, the support finger 15 exhibits a certain flexibility such that the support finger 15 and consequently the application part 20 are rotatable with respect to the support rod 40 and the sleeve 14 (the sleeve 14 being integrated in the support rod 40), particularly along at least two axes of an orthonormal frame. This orthonormal frame is, for example, centred at a point of the main direction X. As such, the two axes are for example the axes referenced Y, Z in FIGS. 1 to 6.

As such, the mobility of the application part 20 with respect to the sleeve 14 has the advantage of providing the applicator tip 10 with the ability to adapt to a wide public seeking to use same to apply makeup therewith.

This example of an embodiment has two use positions seen in FIGS. 2 and 3.

In a first phase, when the user applies light pressure on the tip 10, only the application part 20 buckles such that the proximal end 13 of the application part 20 is at the point of coming or comes into contact with the support finger 15. In other words, the support finger 15 remains straight, i.e. aligned with the sleeve 14 and the support rod 40 and therefore the X axis, and only the area where the pressure is applied is compressed and moves closer to the support finger 15 at the proximal end 13 of the application part. This approach may be carried out until the proximal end 13 of the application part 20 is in contact with the support finger 15, as is the case here. This use position, or first use position, can be seen in FIG. 2.

This use position may also be observed when pressure is applied at the proximal end 13 of the application part 20, enabling pivoting of the application part 20, such that the proximal end 13 of the application part 20 is at the point of coming or comes into contact with the support finger 15.

This position makes it possible to apply the cosmetic product on a lip delicately and in one application particularly as the pressure enables the release of the cosmetic product contained in the cavity 23. Furthermore, the deformability of the application area enables the applicator tip 10 to adapt to any lips. It may also be envisaged that, in another use position not shown, the proximal end 13 of the application part 20 and the support finger 15 move closer but without coming into contact.

It is also remarkable that localized pressure gives rise to deformation of the application area. Herein, as shown in FIG. 2, localized pressure at the location of the proximal end 13 shifts the application part 20 towards the support finger 15. As such, the applicator tip according to the invention adapts particularly to the area whereon makeup is to be applied as the application part 20 is suitable for shifting once it is pushed, touched, pressure, even very locally.

In the use position represented in FIG. 3, or second use position, the user applies more pronounced pressure on the tip 10 or localised pressure more towards the distal end 16 of the application part 20 and the support finger 15 which is flexible buckles. In other words, the support finger 15 is no longer aligned with the sleeve 14 and the support rod 40. The support finger 15 and therefore the application part 20 are inclined with respect to the X axis. In this position, the internal wall 21 of the application part 20 is in contact with the support finger 15, in particular at the pressure point. On the opposite side of the pressure point, the proximal end 13 of the application part 20 is in contact with the support rod 40. This second use position enables greater application of the product. It also makes it possible to supply the remaining product contained in the cavity 23 as the end of application and avoids having to refill the tip 10 by immersing same in the receptacle 50. Here again, the deformation of the application area enables the applicator tip 10 to adapt to any lips.

It is also remarkable herein that localised pressure gives rise to deformation of the support finger 15. Herein, as shown in FIG. 3, localised pressure at the distal end 16 of the application part 20 will give rise to shifting of the applicator assembly. Once again, the applicator tip according to the invention adapts particularly to the area whereon makeup is to be applied as the application part 20 is suitable for shifting once it is pushed, touched, pressure, even very locally.

Figure 5:
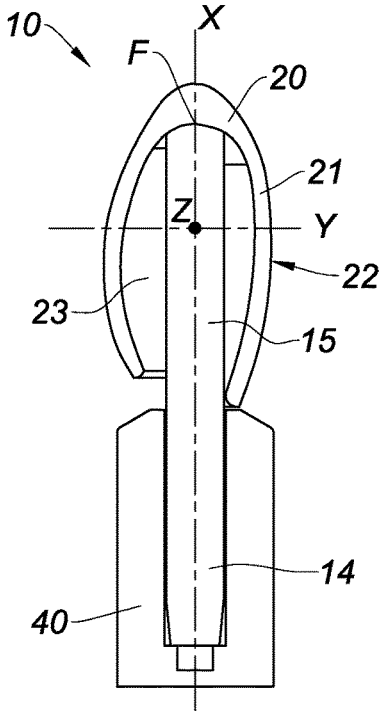
FIG. 5 is a sectional view of the applicator tip in FIG. 4 in a first use position.
Figure 6:
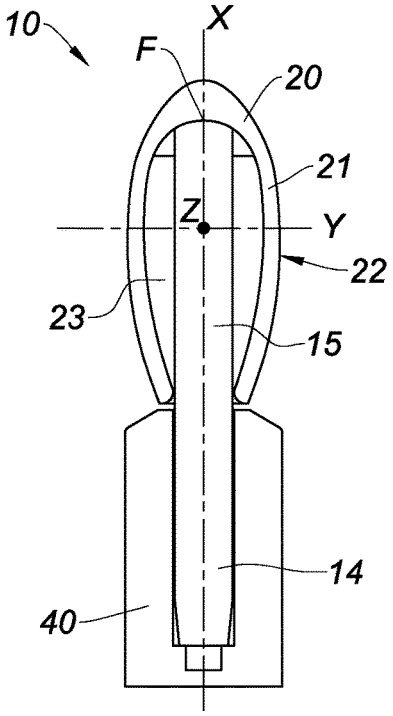
FIG. 6 is a sectional view of the applicator tip in FIG. 4 in a third use position.

In a second embodiment of the applicator tip 10 illustrated in FIGS. 4 to 6, the attachment part 11 and the application part 20 are two separate pieces. The attachment part 11 and the application part 20 may as such be made of different materials. This facilitates the choice of materials wherein the mechanical, aesthetic properties required may differ from the application part 20 and the attachment part 11. It is as such possible to choose a soft, flexible material for the application part 20 and a more rigid material for the attachment part 11. Both materials must be compatible to ensure lasting and strong attachment between the application part 20 and the attachment part 11 which are two separate pieces. This may as such consist, preferably of thermoplastic elastomers (TPE), butadiene-acrylonitrile copolymers, also known as "nitrile rubbers" (NBR), silicones for the application part 20. Whereas for the attachment part 11, this consists preferably of thermoplastic elastomers (TPE), butadiene-acrylonitrile copolymers, also known as "nitrile rubbers" (NBR), silicones. Furthermore, the attachment part 11 may also be made of thermoplastic material such as polypropylene (PP), polyethylene terephthalate (PET) or poly-oxo-methylene (POM).

According to an alternative embodiment of this second embodiment, the attachment part 11 and the rod 40 may be presented in the form of a single piece (not shown). In this case, the attachment part 11 and the rod 40 will be made of thermoplastic material such as polypropylene (PP), polyethylene terephthalate (PET) or poly-oxo-methylene (POM).

In this second embodiment, the cavity is a hollow, in the form of a volume of revolution, about a support finger, delimited by the internal walls and the support finger and forming a container.

In particular, the application part goes around the support finger, particularly on the entire periphery of the finger.

Advantageously, the thickness e20 of the application part 20 is constant over the entire length of the support finger 15 along the X axis. It is the order for example of 0.7 mm. The flexibility of the application surface 22 is as such identical at all points of the application part 20 facilitating the use of the applicator tip 10.

As already explained above, given the shape of the application part 20, the uniformity of the thickness of the wall of the application part 20 gives rise to variability in the thickness of the cavity 23. Consequently, the cavity 23 has a maximum thickness at the maximum diameter d of the application part 20, of the order for example of 0.7 to 1.5 mm. The volume of the cavity 23 is thereby increased and a greater quantity of cosmetic product may be stored. Makeup may be applied to a more extensive surface in a single application without having to refill with product.

An extra thickness may be envisaged at the attachment point F, i.e. at the distal end 16 of the application part 20. This extra thickness, of the order for example of 3 mm, makes it possible to reinforce the attachment between the application part 20 and the support finger 15. In other words, the wall being thicker, it is more difficult to tear and more resistant to multiple uses.

In this example of an embodiment, the material thickness between the internal wall 21 and the external wall 22 is constant and provides the application part 20 with flexibility, which buckles more readily. The attachment part 11 may as such be rigid, equally well at the sleeve 14 as at the support finger 15, without the application tip 10 losing comfort of use. In other words, the application part 20 remains aligned with the sleeve 14 and the support rod 40. The support finger 15 and consequently the application part 20 are therefore no longer rotatable with respect to the support rod 40 and the sleeve 14.

Two illustrations of different use positions of this example of an embodiment can be seen in FIGS. 5 and 6.

The use position shown in FIG. 5 corresponds to the first use position of the first example of an embodiment wherein only the application part 20 buckles on the pressure point side, herein until the proximal end 13 is in contact with the support finger 15. In this first use position, the support finger (15) remains straight, i.e. aligned with the sleeve 14 and the support rod 40 and therefore the X axis, and only the area where the pressure is applied is compressed and herein touches the support finger 15 at the proximal end 13 of the application part. Here again, the proximal end 13 of the application part 20 and the support finger 15 may move closer together but without coming into contact.

FIG. 6 represents a use position, or third use position, wherein two opposite sides of the application part 20 are deformed. This position makes it possible for example to apply makeup on both lips at the same time and also apply pressure on the entire volume of the cavity 23 and thereby supply all the product stored in this cavity 23.

This second example of an embodiment (FIGS. 4 to 6) has at least two use positions thereby enabling the application of makeup on one or both lips and supply more or less product contained in the cavity 23 according to the pressure applied on the application part 20. At the end of the application, if product is still required, greater pressure may be applied to remove the remaining product from the cavity 23.

Though not shown, the third use position may also be envisaged in the first embodiment. Similarly, in the second example of an embodiment, the support finger 15 may be flexible and the use position, or second use position, of the first example, may be envisaged.

Figure 7:
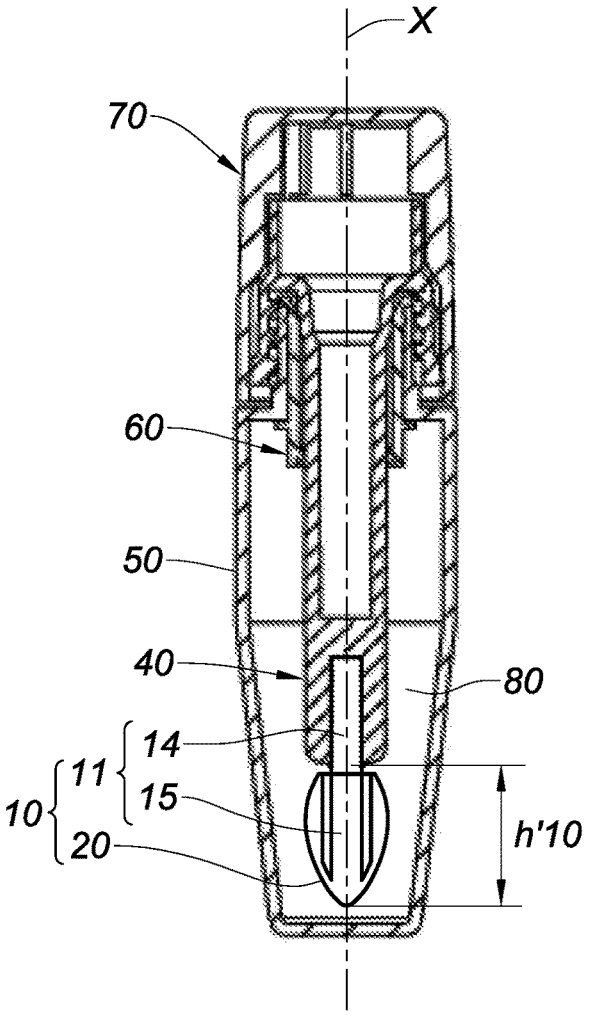
FIG. 7 is a longitudinal sectional view of an example of an embodiment of an applicator assembly according to the invention including the applicator tip in FIGS. 1 to 3.

FIG. 7 illustrates a cosmetic product applicator assembly, including a receptacle 50 including a body 51 forming a container intended to contain the cosmetic product, and an applicator including a tip 10 such as that of the first example of an embodiment described above. The applicator is suitable for being attached to the receptacle 50, such that the applicator tip 10 is housed inside the container. It is as such immersed in the cosmetic product referenced 80 in FIG. 7.

FIG. 7 also illustrates the sleeve 14 assembled with a support rod 40 of the applicator.

The rod 40 enables, inter alia, handling of the applicator tip 10. More specifically, the applicator includes a cap 70 suitable for being handled by the user and the rod 40 extends advantageously from the cap 70.

It should be noted, herein, that the cap 70 is formed from a head 71 made of the same material as the rod 40, and a cover 72 force-fitted and held in position on the head 71 of the rod 40 using internal key forms intended to engage with forms created on the head 71. The cover 72 is rigid. The term "rigid" denotes non-deformable either at atmospheric pressure or at a pressure applied with a user's fingers. It is using the cap 72 that the user handles the applicator according to the invention, in particular because the cover 72 confers the movement given thereto by the user on the head 71 of the rod 40, which in turn transmits this movement to the sleeve 14 with which it is assembled.

Figure 8:
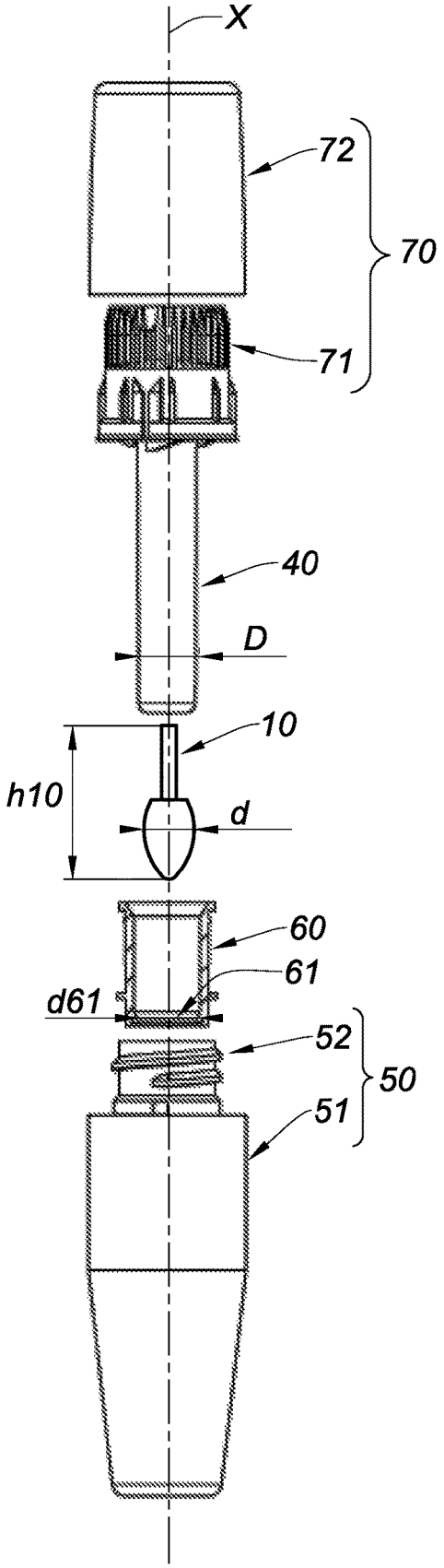
FIG. 8 is an exploded view of the applicator assembly in FIG. 7.

The cap 70 is intended to be removably attached to a neck 52 belonging to the receptacle 50 (see FIG. 7 for the assembled version and FIG. 8 for the exploded version).

It should be noted that the sleeve 14 and the rod 40 each have a substantially cylindrical shape and a main longitudinal extension direction merged with the main direction X.

It should also be noted that the assembly between the sleeve 14 and the rod 40 is an integration. Alternatively, the applicator tip may be over-moulded on or through the rod.

FIG. 8 is an exploded view of the applicator assembly of FIG. 7. FIG. 8 illustrates the receptacle 50 in detail. In particular, the neck 52 includes an opening whereby the cosmetic product may be removed, and a squeezing device 60, intended to be attached to the inside of the neck 52.

It can also be seen, in FIG. 8, that the squeezing device 60 includes a squeezing orifice 61 configured to squeeze the excess cosmetic product on the rod 40 and on the applicator tip 10 when the latter pass therethrough.

The squeezing orifice 61 is advantageously cylindrical in shape; this choice is not limiting and any other shape of orifice 61 may be chosen for the squeezing device 60 without leaving the scope of the invention.

The diameter d61 of the squeezing orifice will be advantageously chosen relative to the diameter D of the rod 40 and the lesser diameter d of the applicator tip 10 for which it squeezes the excess product carried.

In this respect, it should be noted that the diameter D of the rod is comparable to the lesser diameter d of the application part 20. Indeed, the application part 20 has herein a circular cross-section and therefore a diameter d, the two diameters D, d are advantageously correlated by the following formula:

$$0.9 \leq d/D \leq 1.5.$$

As such, by way of example, the diameter D of the rod 40 may be equal to 6.3 mm and the diameter d of the application part 20, to 7.5 mm. This means, furthermore, that the diameter D of the rod will be substantially the same, or even less than that of the application part 20.

It should also be noted that the diameter d61 of the squeezing orifice 61 is substantially the same as that of the rod 40. This offers the advantage of squeezing the product on the applicator tip 10, and in particular squeezing the product on the application part 20 of the applicator tip 10.

A further advantage of the presence of the cavity 23 consists of limiting the force required to remove the applicator from the receptacle and more particularly the force required to remove the application part 20 from the squeezing orifice 61, since the cavity 23 allows some deformation of the application part.

As such, in addition to having a large application surface area, the applicator assembly is devised such that the squeezing of the application part 20 is optimized on the removal thereof from the receptacle 50. In other words, the cosmetic product that the application part 20 is suitable for carrying is squeezed in an optimized manner by the squeezing device 60 through which it passes on the removal thereof from the receptacle 50.

This helps give the applicator tip 10 according to the invention the ability to apply makeup on both of a user's lips, from the first passage of the applicator tip thereon.

Indeed, the invention advantageously relates to one the applicator assembly wherein the container 50 is filled with cosmetic product, the product being in particular intended for applying makeup on a user's lips.

The application part 20 may be smooth. It should be noted, by way of non-exclusive alternative of the invention, that the application part 20 may have flocking on the surface thereof, the flocking particularly including cotton or nylon. According to a further alternative embodiment, the application part 20 may include grooves, particularly of shallow depth, particularly from 200 to 300 micrometers.

The flocking enables superior retention of the cosmetic product and a softer texture. The diameter of the application part 20 provided with the flocking is greater by 0.3 to 2.6 mm according to the flocking selected.

By way of example, the applicator tip 10 will have a height h10 of the order of 22 mm (see FIG. 8) measured between the distal end 16 of the application part 20 and a proximal end 18 of the sleeve 14, along the main direction X.

Once assembled with the rod, the sleeve 14 of the applicator tip 10 is no longer visible, as it is integrated in the rod 40, in particular at the free end thereof. The applicator tip 10 seen is then the application part 20 and the intermediate part 17 of the support finger 15. By way of further example, the height h'10 of these two visible elements, measured along the main direction X, is of the order of 12.5 mm.

The applicator tip according to the invention is simple and modular to make. Indeed, thanks in particular to the design of the application part 20, different use positions can be envisaged. It is thereby possible to modulate the application of the cosmetic product by combining the flexibilities of the application part 20 and the support finger 15 and by applying either discreet pressure, or more pronounced pressure, on one or both lips at the same time. A tip adapting to all users and to the makeup application methods thereof with comfort of use is thereby obtained.

Furthermore, the presence of the cavity 23 (or lack of material) makes it possible to apply makeup on one or both lips in a single application without having to dip the tip back into the receptacle. The supply of product is enhanced and may be complete thanks to the flexibility of the application part 20. Pressure on the application part thereby makes it possible to use the cosmetic product contained in the cavity 23 without having to refill with product.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description; but, is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows:

1. An applicator tip for a cosmetic product intended to be applied on a user's lips, the tip comprising:

an attachment part suitable for being assembled with a support rod and an application part of extending along a main longitudinal extension direction, between a proximal end and a distal end opposite the proximal end, the attachment part comprising a support finger external to the support rod, the application part being attached to the support finger so as to encompass more than half of the support finger, the support finger and the application part being in discrete contact over a limited area near the distal end of the application part, the application part having a configuration to switch from an idle position wherein the support finger and the proximal end of the application part are free from any contact, to a use position, wherein the support finger and/or the application part yield such that the proximal end of the application part is at the point of coming, or comes, into contact with the support finger and/or the support rod, wherein the application part has an external wall and an internal wall opposite separated by a material thickness, the external wall merging with a continuous application surface devoid of protuberances, the application part further comprising a gap formed between the internal wall and the support finger so as to delimit a cavity, wherein the cavity is hollow, in a form of a volume of revolution, about the support finger, wherein the support finger is connected to the internal wall of the application part at an attachment point that corresponds to a cross-section of the support finger.

2. The applicator tip of claim 1, wherein the support finger and the application part are at the point of coming or come into contact via the internal wall of the application part.

3. The applicator tip of claim 1, wherein the attachment part and the application part are two separate pieces.

4. The applicator tip according to claim 1, wherein the attachment part and the application part are a single piece.

5. The applicator tip according to claim 1, wherein the support finger is rigid.

6. The applicator tip according to claim 1, wherein the support finger is flexible.

7. The applicator tip according to claim 1, wherein the cavity serves as an intermediate container for the cosmetic product to be applied.

8. The applicator tip according to claim 1, wherein the material thickness between the internal wall and the external wall of the application part is variable.

9. The applicator tip according to claim 1, wherein the application part comprises at least one opening.

10. An applicator comprising:

an applicator tip for a cosmetic product and a support rod, the applicator tip comprising:

an attachment part suitable for being assembled with the support rod and an application part of said product extending along a main longitudinal extension direction, between a proximal end and a distal end opposite the proximal end, the attachment part comprising a support finger external to the support rod, the application part being attached to the support finger so as to encompass more than half of the support finger, the support finger and the application part being in discrete contact over a limited area near the distal end of the application part, the application part having a configuration to switch from an idle position wherein the support finger and the proximal end of the application part are free from any contact, to a use position, wherein the support finger and/or the application part yield such that the proximal end of the application part is at the point of coming, or comes, into contact with the support finger and/or the support rod, wherein the application part has an external wall and an internal wall opposite separated by a material thickness, the external wall merging with a continuous application surface devoid of protuberances, the application part further comprising a gap formed between the internal wall and the support finger so as to delimit a cavity, wherein the cavity is hollow, in a form of a volume of revolution, about the support finger, wherein the support finger is connected to the internal wall of the application part at an attachment point that corresponds to a cross-section of the support finger.

11. A cosmetic product applicator assembly, comprising:

a receptacle comprising a body forming a container adapted to contain a cosmetic product, and an applicator adapted for attachment to the receptacle, the applicator comprising an applicator tip and a support rod, such that the applicator tip is housed inside the container, the applicator tip comprising:

an attachment part suitable for being assembled with the support rod and an application part of said product extending along a main longitudinal extension direction, between a proximal end and a distal end opposite the proximal end, the attachment part comprising a support finger external to the support rod, the application part being attached to the support finger so as to encompass more than half of the support finger, the support finger and the application part being in discrete contact over a limited area near the distal end of the application part, the application part having a configuration to switch from an idle position wherein the support finger and the proximal end of the application part are free from any contact, to a use position, wherein the support finger and/or the application part yield such that the proximal end of the application part is at the point of coming, or comes, into contact with the support finger and/or the support rod, wherein the application part has an external wall and an internal wall opposite separated by a material thickness, the external wall merging with a continuous application surface devoid of protuberances, the application part further comprising a gap formed between the internal wall and the support finger so as to delimit a cavity, wherein the cavity is hollow, in a form of a volume of revolution, about the support finger, wherein the support finger is connected to the internal wall of the application part at an attachment point that corresponds to a cross-section of the support finger.

* * * * *